US008944770B2

(12) United States Patent
Alvanos et al.

(10) Patent No.: US 8,944,770 B2
(45) Date of Patent: Feb. 3, 2015

(54) INTEGRATED CERAMIC MATRIX COMPOSITE ROTOR DISK HUB GEOMETRY FOR A GAS TURBINE ENGINE

(75) Inventors: Ioannis Alvanos, West Springfield, MA (US); Gabriel L. Suciu, Glastonbury, CT (US); Brian D. Merry, Andover, CT (US); Christopher M. Dye, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 832 days.

(21) Appl. No.: 13/116,076

(22) Filed: May 26, 2011

(65) Prior Publication Data

US 2012/0301305 A1 Nov. 29, 2012

(51) Int. Cl.

| | |
|---|---|
| ***F01D 5/06*** | (2006.01) |
| ***F01D 5/28*** | (2006.01) |
| ***F01D 5/02*** | (2006.01) |
| ***F01D 5/34*** | (2006.01) |

(52) U.S. Cl.

CPC ..... *F01D 5/282* (2013.01); *F01D 5/026* (2013.01); *F01D 5/066* (2013.01); *F01D 5/284* (2013.01); *F01D 5/34* (2013.01); *F05D 2300/6033* (2013.01)

USPC ..... 416/201 R

(58) Field of Classification Search

USPC ..... 416/201 R, 198 R, 198 A, 210 A

See application file for complete search history.

(56) References Cited

U.S. PATENT DOCUMENTS

| | | | | |
|---|---|---|---|---|
| 5,632,600 | A | 5/1997 | Hull | |
| 6,053,697 | A * | 4/2000 | Piekarski et al. | 415/115 |
| 6,213,720 | B1 * | 4/2001 | Farmer | 416/229 A |
| 7,329,101 | B2 | 2/2008 | Carper et al. | |
| 7,491,032 | B1 | 2/2009 | Powell et al. | |
| 7,510,379 | B2 | 3/2009 | Marusko et al. | |
| 7,632,072 | B2 * | 12/2009 | Sheffield | 416/97 R |
| 7,766,623 | B2 | 8/2010 | Chou et al. | |
| 7,811,062 | B1 | 10/2010 | Twigg | |
| 2002/0108376 | A1 * | 8/2002 | Stevens | 60/772 |
| 2005/0254942 | A1 * | 11/2005 | Morrison et al. | 415/200 |
| 2008/0089788 | A1 * | 4/2008 | Loehle et al. | 416/191 |

FOREIGN PATENT DOCUMENTS

| | | |
|---|---|---|
| JP | 09125902 | 5/1997 |

* cited by examiner

*Primary Examiner* — Edward Look
*Assistant Examiner* — Michael Sehn
(74) *Attorney, Agent, or Firm* — Carlson, Gaskey & Olds, P.C.

(57) ABSTRACT

A rotor disk for a gas turbine engine includes a CMC hub and a rail integrated with the CMC hub opposite the multiple of CMC airfoils, the rail defines a rail platform section that tapers to a rail inner bore.

8 Claims, 4 Drawing Sheets

INTEGRATED CERAMIC MATRIX COMPOSITE ROTOR DISK HUB GEOMETRY FOR A GAS TURBINE ENGINE

BACKGROUND

The present disclosure relates to a gas turbine engine, and more particularly to Ceramic Matrix Composites (CMC) rotor disk components therefore.

The turbine section of a gas turbine engine operates at elevated temperatures in a strenuous, oxidizing type of gas flow environment and is typically manufactured of high temperature superalloys. Turbine rotor assemblies often include a multiple of rotor disks that may be fastened together by bolts, tie rods and other structures.

Each of the rotor disks includes a multiple of shrouded blades which are typically retained through a firtree slot arrangement within a rim of the rotor disk. The innermost diameter of the rotor disk defines a bore that provides self-retention capabilities through the minimization of excessive hoop growth that would otherwise occur without this feature. The conventional bore geometrically includes a thin mid-section that extends radially inward from the rim and flares out at an innermost diameter (FIG. 3). This geometry may not lend itself to Ceramic matrix composites (CMC).

SUMMARY

A disk for a gas turbine engine according to an exemplary aspect of the present disclosure includes a CMC hub and a rail integrated with the CMC hub. The rail defines a rail platform section that tapers to a rail inner bore. An arm is integrated with the CMC hub. The arm extends axially from the CMC hub at a radial distance from the axis that is equal to a self-sustaining radius wherein mass radially inboard of the self-sustaining radius is load carrying and mass radially outboard of the self-sustaining radius is not load carrying and cannot support itself.

A CMC disk for a gas turbine engine according to an exemplary aspect of the present disclosure includes a multiple of airfoils which extend from a CMC hub and a rail integrated with said CMC hub opposite said multiple of airfoils. The rail defines a rail platform section adjacent to the multiple of airfoils that tapers to a rail inner bore. An arm is integrated with the CMC hub. The arm extends axially from the CMC hub at a radial distance from the axis that is equal to a self-sustaining radius wherein mass radially inboard of the self-sustaining radius is load carrying and mass radially outboard of the self-sustaining radius is not load carrying and cannot support itself.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
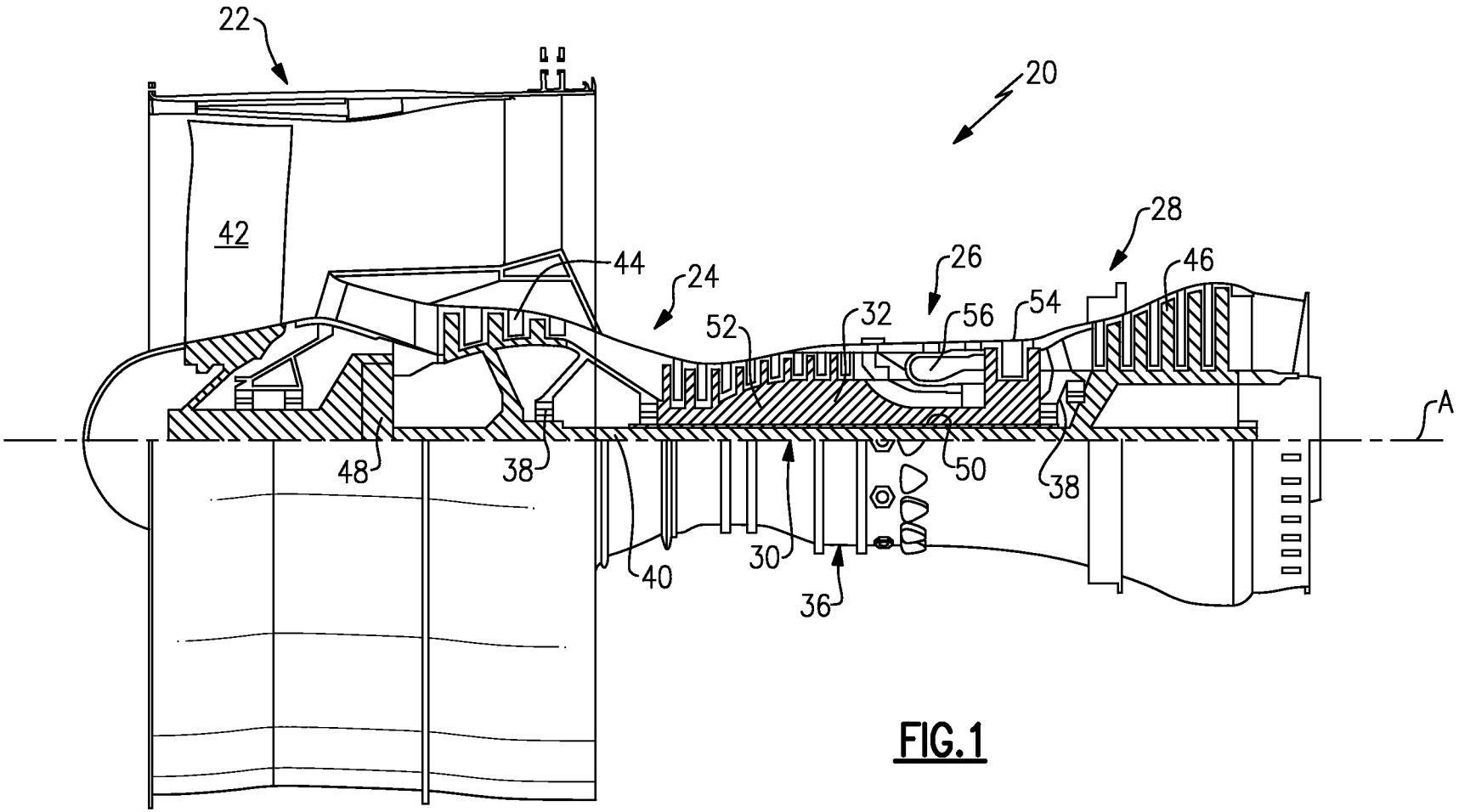
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low-speed spool 30 and a high-speed spool 32 mounted for rotation about an engine central longitudinal axis A relative to an engine static structure 36 via several bearing systems 38. It should be understood that various systems 38 at various locations may alternatively or additionally be provided.

The low-speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low-speed spool 30. The high-speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low-speed spool 30 and high-speed spool 32 in response to the expansion.

Figure 2:
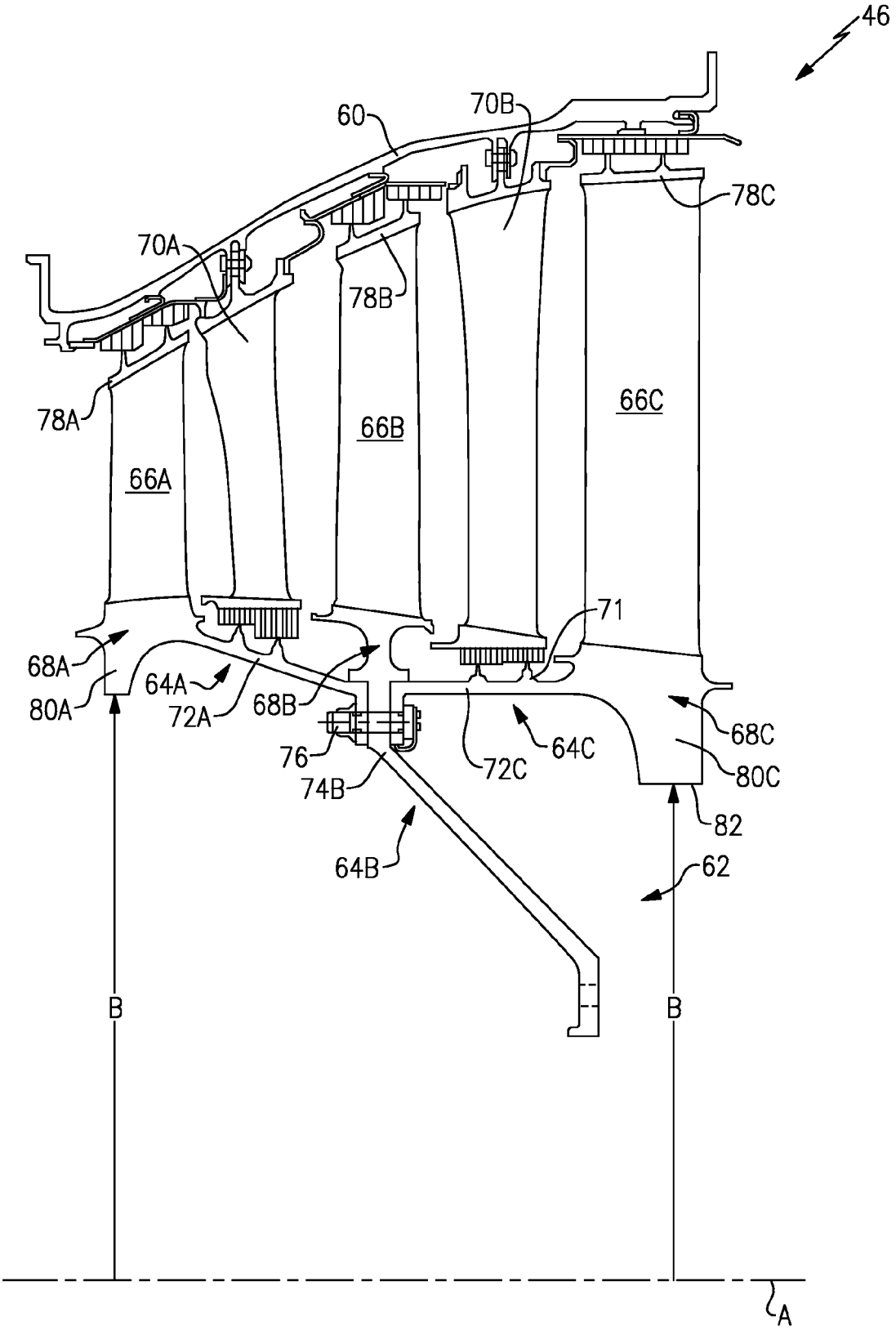
FIG. 2 is an enlarged sectional view of a section of the gas turbine engine.

With reference to FIG. 2, the low pressure turbine 46 generally includes a low pressure turbine case 60 with a multiple of low pressure turbine stages. In the disclosed non-limiting embodiment, the low pressure turbine case 60 is manufactured of a ceramic matrix composite (CMC) material or metal super alloy. It should be understood that examples of CMC material for all componentry discussed herein may include, but are not limited to, for example, S200 and SiC/SiC. It should be also understood that examples of metal superalloy for all componentry discussed herein may include, but are not limited to, for example, INCONEL 718 and WASPALOY. INCONEL 718 is a nickel-chromium-based superalloy and WASPALOY is a nickel-based superalloy, the compositions of which are known. Although depicted as a low pressure turbine in the disclosed embodiment, it should be understood that the concepts described herein are not limited to use with low pressure turbine as the teachings may be applied to other sections such as high pressure turbine, high pressure compressor, low pressure compressor and intermediate pressure turbine and intermediate pressure turbine of a three-spool architecture gas turbine engine.

A rotor module 62 includes a multiple (three shown) of CMC disks 64A, 64B, 64C. Each of the CMC disks 64A, 64B, 64C include a row of airfoils 66A, 66B, 66C which extend from a respective hub 68A, 68B, 68C. The rows of airfoils 66A, 66B, 66C are interspersed with CMC vane structures 70A, 70B to form a respective number of LPT stages. It should be understood that any number of stages may be provided. The disk may further include a ring-strut ring construction.

The CMC disks 64A, 64C include arms 72A, 72C which extend from the respective hub 68A, 68C. The arms 72A, 72C are located a radial distance from the engine axis A generally equal to the self sustaining radius. The self sustaining radius is defined herein as the radius where the radial growth of the disk equals the radial growth of a free spinning ring. Mass radially inboard of the self sustaining radius is load carrying and mass radially outboard of the self-sustaining radius is not load carrying and can not support itself. Disk material outboard of the self-sustaining radius may generally increase bore stress and material inboard of the self-sustaining radius may generally reduce bore stress.

The arms 72A, 72C trap a mount 74B which extends from hub 68B. A multiple of fasteners 76 (only one shown) mount the arms 72A, 72C to the mount 74B to assemble the CMC disks 64A, 64B, 64C and form the LPT rotor module 62. The radially inwardly extending mount 74B collectively mounts the LPT rotor module 62 to the inner rotor shaft 40 (FIG. 1). The arms 72A, 72C typically include knife edge seals 71 which interface with the CMC vane structures 70A, 70B.

Each of the CMC disks 64A, 64B, 64C utilize the CMC hoop strength characteristics of an integrated bladed rotor with a full hoop shroud to form a ring-strut-ring structure. The term "full hoop" is defined herein as an uninterrupted member such that the airfoils do not pass through apertures formed therethrough.

An outer shroud 78A, 78B, 78C of each of the CMC disks 64A, 64B, 64C forms the full hoop ring structure at an outermost tip of each respective row of airfoils 66A, 66B, 66C which is integrated therewith with large generous fillets to allow the fibers to uniformly transfer load. The root portion of the airfoils are also integrated into the full hoop disk with generous fillets to allow for the fibers to again better transfer load through the structure to the respective hub 68A, 68B, 68C. It should be understood that various CMC manufacturing and ply structures may be utilized.

Figure 3:
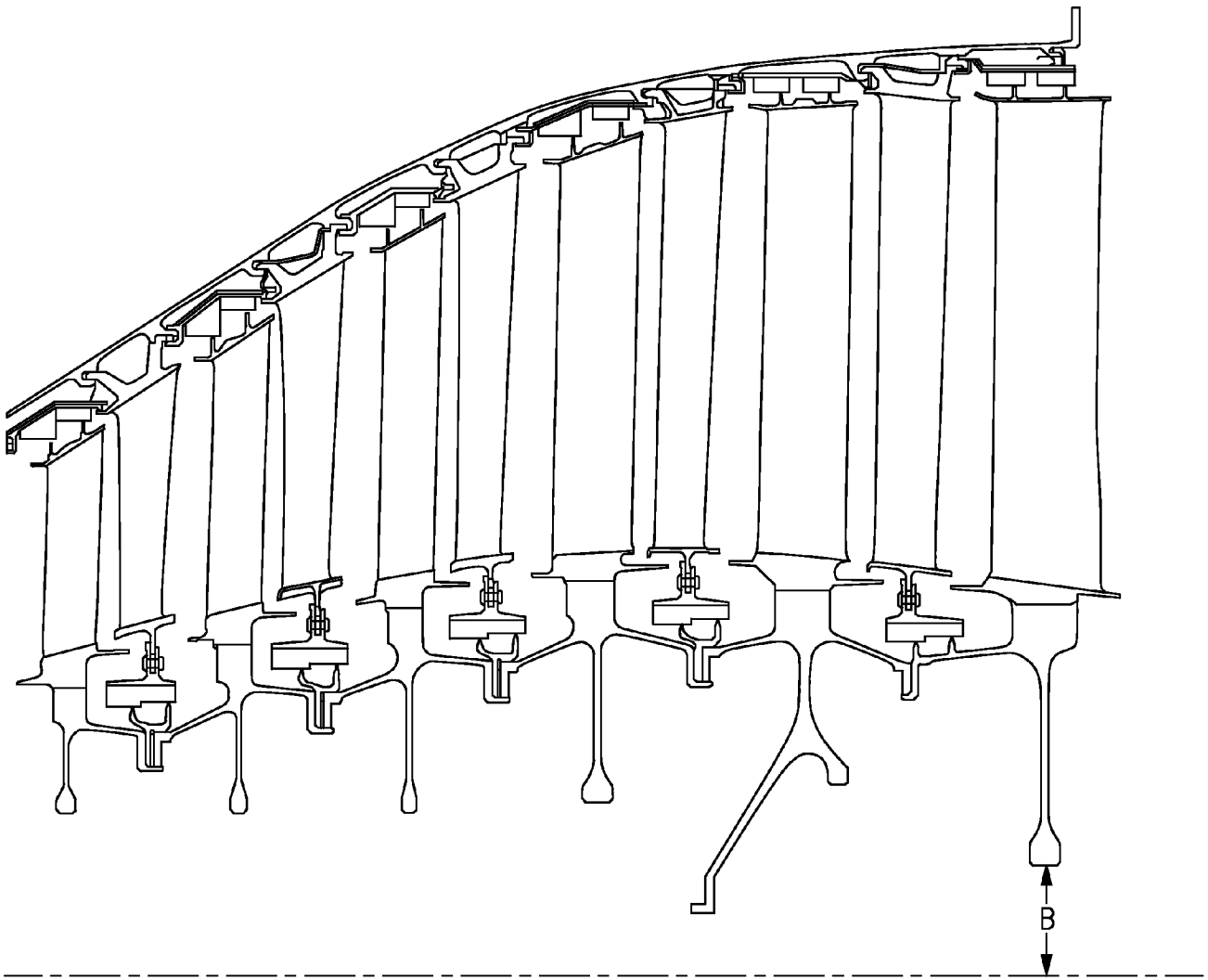
FIG.3 Related Art
FIG. 3 is a RELATED ART rotor module.

Each hub 68A, 68C defines a rail 80A, 80C which defines the innermost bore radius B relative to the engine axis A. The innermost bore radius B of each of the CMC disks 64A, 64B, 64C is significantly greater than a conventional rim, disk, bore, teardrop-like structure in cross section (FIG. 3; RELATED ART). That is, the innermost bore radius B of each rail 80A, 80C defines a relatively large bore diameter which reduces overall disk weight. The term "rail" as utilized herein is the annular structure inboard of the row of airfoils 66A, 66B, 66C which essentially replace the conventional rim, disk, bore, teardrop-like structure.

The rail geometry readily lends itself to CMC material and preserves continuity of the internal stress carrying fibers. The rail design further facilitates the balance of hoop stresses by minimization of free ring growth and minimizes moments which cause rolling that may otherwise increase stresses.

Figure 4:
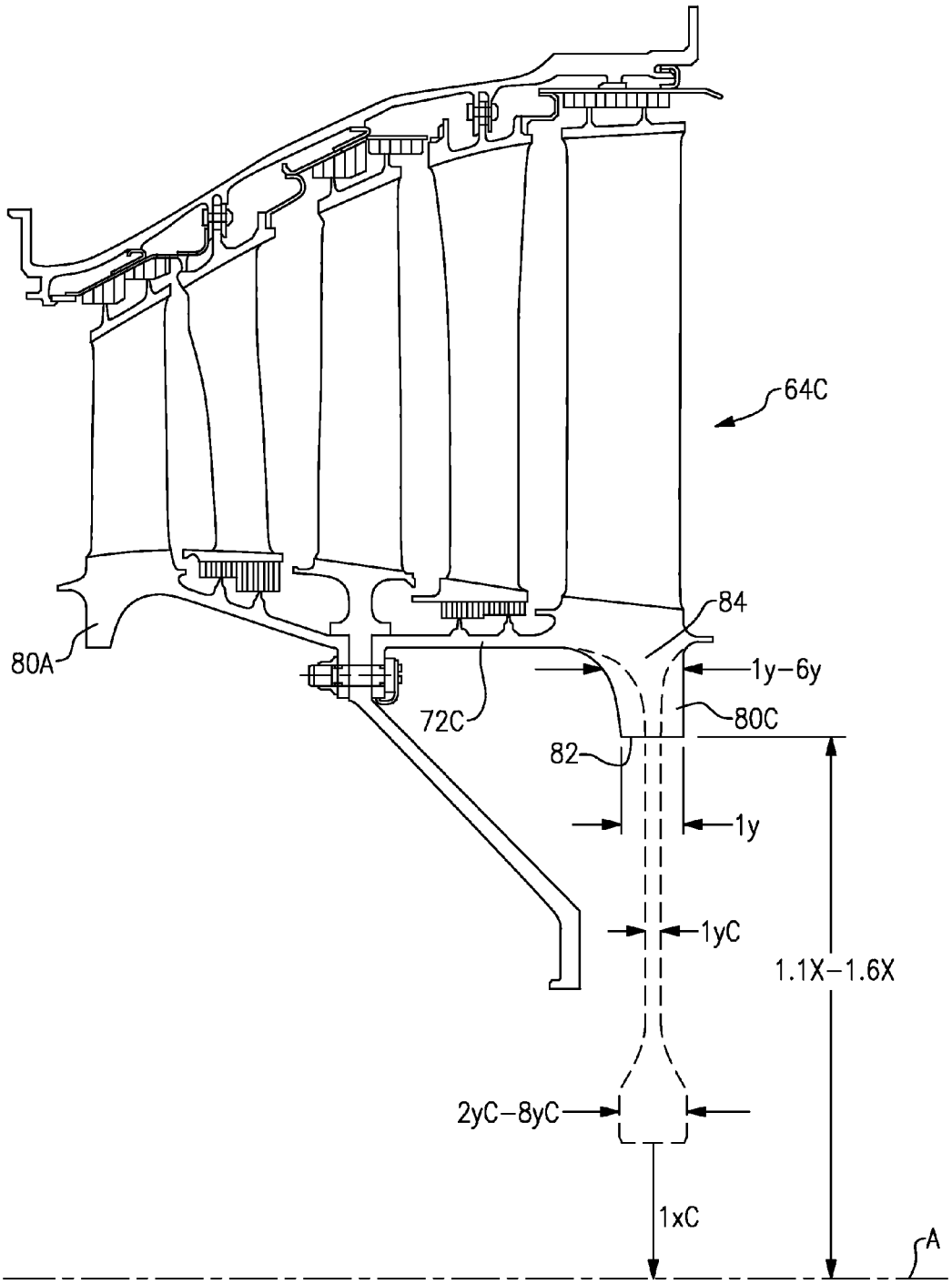
FIG. 4 is a side view of a rotor module according to one non-limiting embodiment compared to a RELATED ART disk shown in phantom.

With reference to FIG. 4, in one disclosed non-limiting embodiment, the rail inner bore 82 defines a radial dimension of 1.1X–1.6X as compared to an inner bore diameter 1×C of the conventional rim, disk, bore teardrop-like structure. The geometry of each rail 80A, 80C defines the innermost bore radius B at a rail inner bore 82. That is, each rail 80A, 80C is relatively axially thick at a rail platform section 84 at an outer diameter adjacent to the airfoils 66A, 66C, then tapers toward the rail inner bore 82. The rail platform section 84 is radially located generally where the arms 72A, 72C extend from the respective hub 68A, 68C. In one disclosed non-limiting embodiment, the rail inner bore 82 defines an axial thickness 1y and the rail platform section 84 defines an axial thickness of 1y to 6y as compared to the conventional rim, disk, bore teardrop-like structure in which the bore defines a thickness of approximately 2yC to 8yC relative to the disk thickness of 1yC.

The ring-strut-ring configuration utilizes the strengths of CMC by configuring an outer and inner ring with airfoils that are tied at both ends. Disposing of the fir tree attachment also eliminates many high stresses/structurally complex areas typical of conventional rim, disk, bore, teardrop-like structures. The integrated disk design still further provides packaging and weight benefit—even above the lower density weight of CMC offers—by elimination of the rim, disk, bore, neck and firtree attachment areas of the conventional blade and disk geometries.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A disk for a gas turbine engine comprising:

a CMC hub defined about an axis;

a rail integrated with said CMC hub, said rail defines a rail platform section that tapers to a rail inner bore;

an arm integrated with said CMC hub, said arm extending axially from said CMC hub at a radial distance from said axis that is equal to a self-sustaining radius wherein mass radially inboard of said self-sustaining radius is load carrying and mass radially outboard of said self-sustaining radius is not load carrying and cannot support itself; and multiple CMC airfoils integrated with and extending radially outwards from said CMC hub in a circumferential arrangement, and said CMC hub, said rail, and said multiple CMC airfoils form a monolithic piece with a continuity of fibers.

2. The disk as recited in claim 1, wherein said rail inner bore defines an axial thickness 1y and said rail platform section defines an axial thickness of 1y to 6y.

3. The disk as recited in claim 1, wherein said rail has a minimum axial thickness at an innermost bore radius of said rail.

4. The disk as recited in claim 1, further comprising an outer shroud defined about said multiple of CMC airfoils.

5. The disk as recited in claim 1, wherein an end of said arm is configured to be secured to a mating component with a fastener, and said CMC hub includes only one such arm.

6. A CMC disk for a gas turbine engine comprising:

a CMC hub defined about an axis;

a multiple of airfoils which extend from said CMC hub;

a rail integrated with said CMC hub opposite said multiple of airfoils, said rail defines a rail platform section adjacent to said multiple of airfoils that tapers to a rail inner bore; and an arm integrated with said CMC hub, said arm extending axially from said CMC hub at a radial distance from said axis that is equal to a self-sustaining radius wherein mass radially inboard of said self-sustaining radius is load carrying and mass radially outboard of said self-sustaining radius is not load carrying and cannot support itself, wherein said CMC hub, said rail. and said multiple CMC airfoils form a monolithic piece with a continuity of fibers.

7. The CMC disk as recited in claim 6, wherein said rail has a minimum axial thickness at an innermost bore radius of said rail.

8. The CMC disk as recited in claim 6, wherein said rail inner bore defines an axial thickness 1y and said rail platform section defines an axial thickness of 1y to 6y.

* * * * *